US005214877A

United States Patent [19]

Kaspar et al.

[11] Patent Number: 5,214,877

[45] Date of Patent: Jun. 1, 1993

[54] REFRIGERATOR DOOR ASSEMBLY WITH VENTING SYSTEM

[75] Inventors: Melvin Kaspar, LaGrange Park; Matthew Rolek, Chicago, both of Ill.

[73] Assignee: Ardco, Inc., Chicago, Ill.

[21] Appl. No.: 902,974

[22] Filed: Jun. 23, 1992

[51] Int. Cl.[5] ..... E06B 7/12

[52] U.S. Cl. ..... 49/70; 49/402; 49/471; 312/296

[58] Field of Search ..... 49/700, 402, 471, 485, 49/504; 312/293.2, 296

[56] References Cited

U.S. PATENT DOCUMENTS

| | | | |
|---|---|---|---|
| 3,673,735 | 7/1972 | Winsler et al. | 49/70 |
| 4,004,370 | 1/1977 | Heaney | 49/70 |
| 4,127,765 | 11/1978 | Heaney | 49/70 X |
| 4,248,015 | 2/1981 | Stromquist et al. | 49/70 |
| 4,578,902 | 4/1986 | Niekrasz et al. | 49/70 |
| 4,948,206 | 8/1990 | Fitzpatrick | 49/402 X |

*Primary Examiner*—Philip C. Kannan

*Attorney, Agent, or Firm*—Leydig, Voit & Mayer

[57] ABSTRACT

A vent plate is attached to the bottom frame member of a door mounting frame of the insulated door assembly of a refrigerator unit. The vent plate includes passages which enable ambient air to be drawn into the cabinet of the refrigerator unit at a controlled location in order to avoid frost build up.

12 Claims, 2 Drawing Sheets

REFRIGERATOR DOOR ASSEMBLY WITH VENTING SYSTEM

FIELD OF THE INVENTION

The present invention relates generally to refrigerator units and door assemblies therefor, and particularly, to door assemblies for low temperature freezer units such as used in commercial establishments for maintaining and displaying frozen food products.

BACKGROUND OF THE INVENTION

Refrigeration units used in commercial establishments for the display and storage of food products commonly have insulated glass door assemblies which permit viewing of the products in the refrigeration cabinet by passing customers. Customers typically open and close the doors frequently to obtain access to the frozen products. Each time the door is opened, relatively warm ambient air is permitted to enter the refrigeration cabinet. When the door is again closed, this relatively warm air is cooled and contracts and tends to create a vacuum within the cabinet. The vacuum which is thus created sucks or draws in further ambient air through points of least resistance throughout the cabinet. As such ambient air is being drawn into the freezer cabinet, it often is cooled below the dew point of temperature of the air, causing condensation of moisture and the undesirable build up of moisture and frost at or near the point of entry. Such build up creates an unsightly appearance and, in severe cases, can impede operation of the doors.

To overcome this problem, it has been the practice heretofore to form apertures in the sealing gasket about the perimeter of the door in order to create passageways through which ambient air may be drawn as a result of suction developed within the refrigeration cabinet. Since the gasket is relatively flexible, it has been necessary to include rigid spacer elements within the gasket to prevent the venting apertures from being closed when the gasket is pressed into sealing engagement with the refrigerator cabinet. During use of such an arrangement, it has been found that condensation from ambient air that is cooled during passage through such venting apertures tends to accumulate and sometimes freeze within the gasket, impeding its effective sealing ability. Moreover, such arrangements have not enabled existing refrigeration cabinets to be easily converted in the field to have venting capability. Proposals to provide venting apertures in the cabinet itself have not met with favor since they require significant modifications to the refrigerator cabinet and the multi-layered insulation therein.

OBJECT AND SUMMARY OF THE INVENTION

It is an object of the present invention to provide a refrigeration unit with a new and improved insulated glass door assembly which permits venting of ambient air into the cabinet resulting from a vacuum within the cabinet without the undesirable or unsightly accumulation of condensation or frost.

Another object is to provide a refrigeration unit and insulated door assembly as characterized above which requires neither modification of the cabinet nor the sealing gasket of the door assembly.

A further object is to provide an insulated glass door assembly having a venting system which is relatively simple and economical and which lends itself to easy retrofitting of existing refrigeration units in the field.

Still another object is to provide an insulated glass door assembly having a venting system adapted to permit venting at controlled locations which neither adversely affect the function of the door or create an unsightly condition.

These and other objects and advantages of the invention will become more apparent from the following detailed description when taken in conjunction with the accompanying drawings.

DETAILED DESCRIPTION OF THE PREFERRED EMBODIMENT

Figure 3:
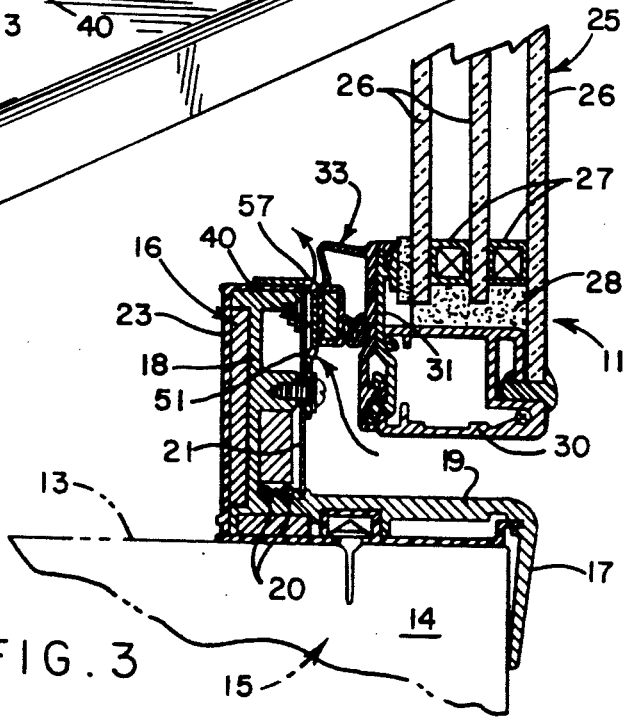
FIG. 3 is an enlarged fragmentary cross-section taken substantially along the line 3—3 of FIG. 1.

For purposes of illustration, the invention has been shown in the drawings as embodied in a refrigerator door assembly 10 comprising a plurality of insulated glass doors 11 mounted for swinging movement in a door mounting cabinet frame 12 which, in turn, is mounted within an opening 13 (FIG. 3) in a front wall 14 of a refrigerator cabinet 15 or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening 13 in the wall 14 and includes a plurality of mullions that extend vertically between the top and bottom perimeters of the frame to provide rigidity for the frame and define sealing surfaces against which the free swinging sides of the doors 11 engage when in a closed condition.

The cabinet frame 12 includes a plurality of frame members, preferably in the form of extrusions made of aluminum or other suitable metal, arranged in a rectangular configuration about the periphery of the opening 13. The horizontally extending bottom frame member 16 of the frame 12 is shown in detail in FIG. 3 and, as illustrated, is of generally Z-shaped configuration comprising a downwardly projecting front flange 17, an upwardly projecting rear flange 18, and a generally horizontal web 19 extending therebetween. The rear flange 18 is of a hollow construction and receives one or more electrical heating cables 20 for the purpose of maintaining the extrusion at a temperature sufficient to help avoid a build up of condensation. A cover plate 21 is fixed removably to the front of the rear flange 18 and its outer face 22 (FIG. 2 and FIGS. 4–6) defines a sealing surface against which portions of the bottoms of the doors 11 close, the sealing surface extending horizontally and being disposed in an upright plane.

An insulating strip 23 (FIG. 3), preferably made of plastic, is associated with the frame member 16. Reference may be made to Fitzpatrick U.S. Pat. No. 4,948,206 for a detailed disclosure of the structure and function of the insulating strip.

Each door 11 includes an insulated glass unit 25 (FIG. 3) herein comprising three glass panes 26 disposed in parallel face-to-face relation and separated by spacers 27. As is well known in the art, the spacers may comprise elongated metal tubular members spaced inwardly a short distance from the peripheral edges of the glass panes, there being a sealant (not shown) between the sides of the spacers and the adjacent panes for establishing a primary vapor seal. A layer 28 of flexible sealant fills the area between the panes about the outer periphery of the spacers.

For supporting the glass unit 25, each door 11 has an outer frame 30 (FIG. 3), preferably extruded from aluminum, disposed along the peripheral side of the glass unit. To retain the glass unit 25 within the metal frame 30, a molding strip 31 made of aluminum, rigid PVC, or the like is fastened to the rear side of the frame and engages the rear side of the glass unit. A sealing strip or gasket 33 is secured to the rear side of the molding strip in order to provide a seal between the door 11 and the cabinet frame 12 when the door is in a closed position. The gasket includes a tubular portion 34 (FIG. 4) of rectangular cross-section and containing magnets 35 for creating a magnetic attraction with the sealing surface 22 of the cover plate 21 of the cabinet frame member 16. Reference may be made to the aforementioned Fitzpatrick patent for a more detailed disclosure of an insulated refrigerator door which is generally similar to the door 11.

Each time the door 11 is opened, relatively warm ambient air enters the freezer cabinet 15. When such air cools and condenses, it creates a vacuum which tends to draw additional warm outside air into the cabinet through points of least resistance between the sealing gasket 33 and the sealing surface 22. When such air is cooled beyond its dew point, it condenses and may cause frost or condensation to accumulate at the points of entry. Condensation and frost are objectionable both from an appearance standpoint and from an operational standpoint and, in most conventional freezer units, there is little or no control over condensation and frost resulting from warm air being sucked into the cabinet.

In accordance with the present invention, the cover plate 21 of the door frame member 16 is equipped with vent means for permitting ambient air to be drawn into the freezer cabinet 15 in a controlled manner and at a controlled location. As will become apparent subsequently, controlling the point of entry of the warm air by way of the vent means prevents frost build up and significantly reduces the accumulation of moisture resulting from condensation in undesirable places which could otherwise affect the function or appearance of the door assembly.

Figure 1:
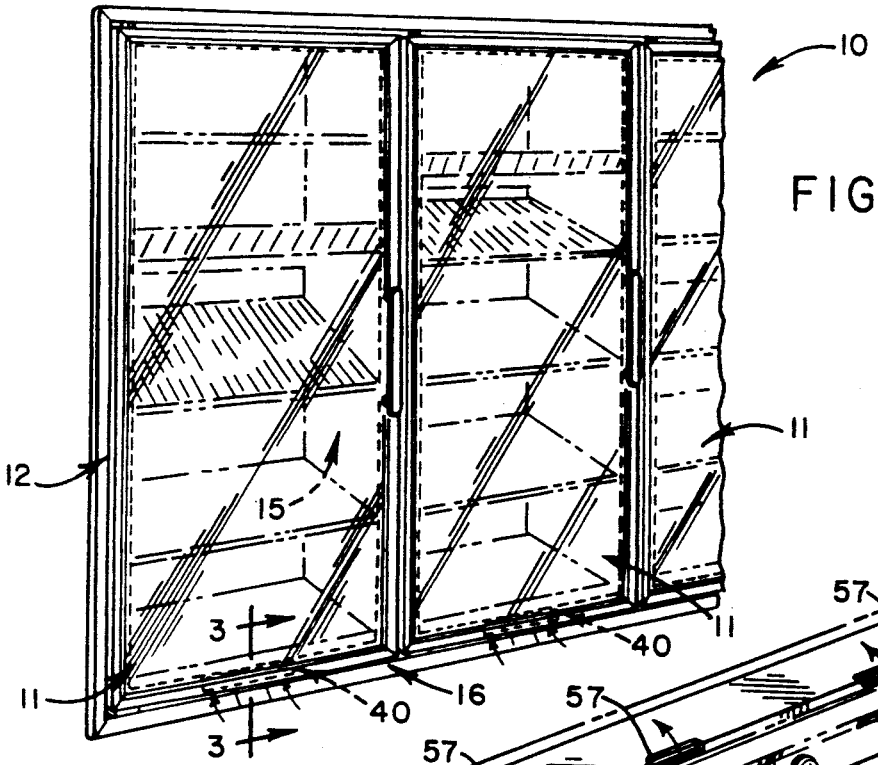
FIG. 1 is a perspective view of a typical refrigerator unit equipped with a new and improved door assembly incorporating the unique features of the present invention.
Figure 2:
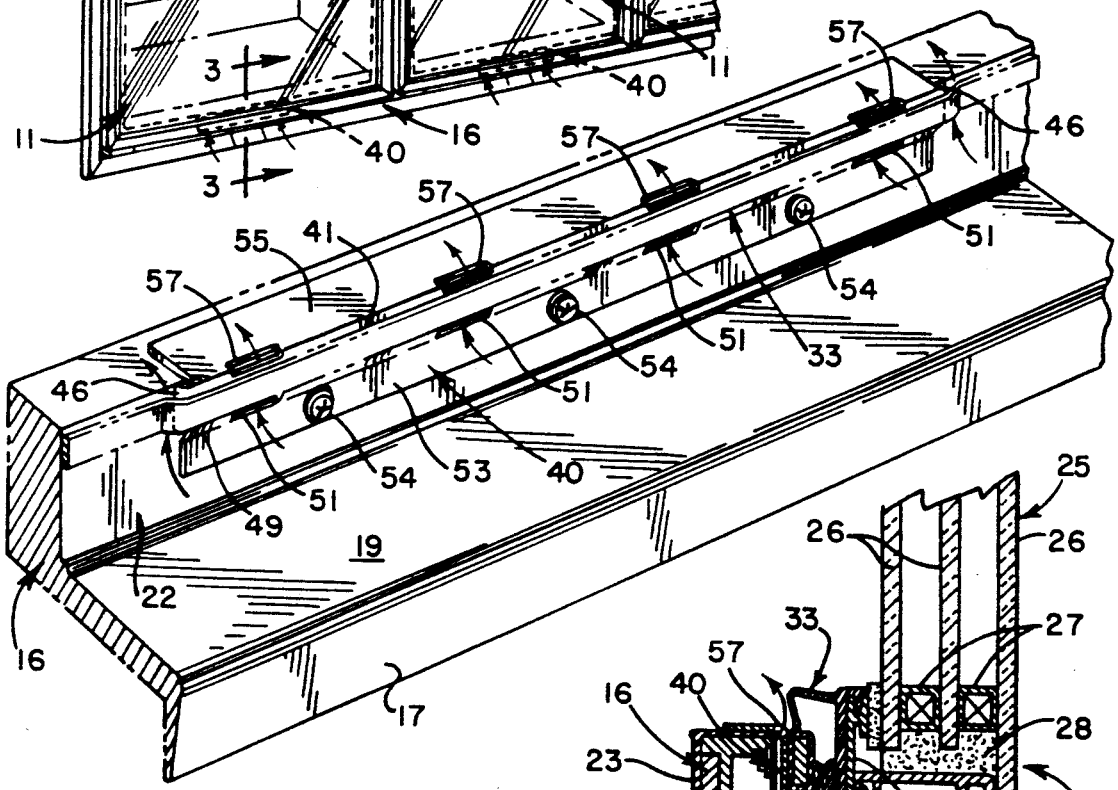
FIG. 2 is an enlarged fragmentary perspective view showing part of the door assembly and showing the venting system thereof.
Figure 4:
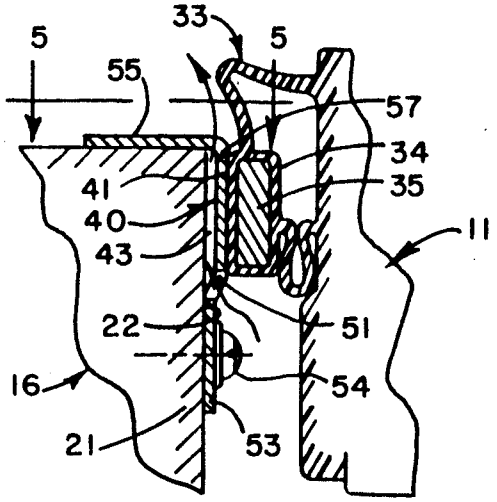
FIG. 4 is an enlarged view of certain components shown in FIG. 3, some of the components being illustrated somewhat schematically.
Figure 5:
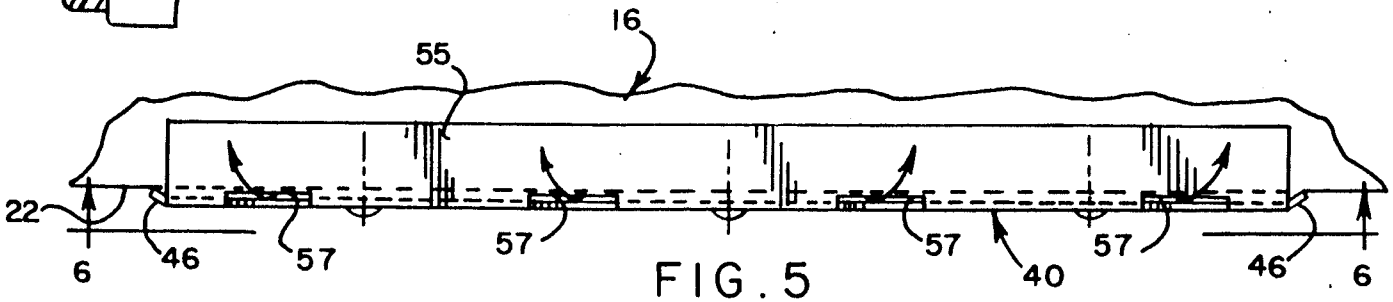
FIG. 5 is a top plan view as seen substantially along the line 5—5 of FIG. 4.
Figure 6:
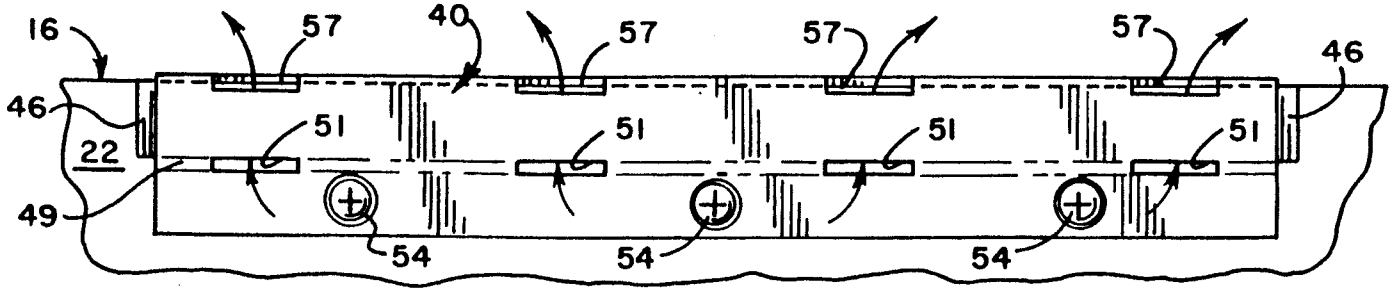
FIG. 6 is a front elevational view as seen substantially along the line 6—6 of FIG. 5.

In the specific embodiment which has been illustrated, the vent means are incorporated in a plate 40 which is attached to the cover plate 21 on the horizontal bottom member 16 of the door frame 12, there being one plate 40 for each door 11 Herein, the vent plate 40 for each door is formed from a single elongated piece of sheet metal and includes an elongated and generally horizontally extending strip 41 which is disposed in a vertical plane. The inner face of the strip 41 is spaced outwardly from the outer face 22 of the cover plate 21 and coacts therewith to define a chamber 43 (FIG. 4). The outer face 45 of the strip 41 defines a sealing surface disposed in a vertical plane which is spaced outwardly from the plane occupied by the sealing surface 22 of the cover plate 21. When the door 11 is closed, the sealing gasket 33 first engages the sealing surface 45 of the strip 41 and then flexes around inwardly bent ends 46 (FIGS. 3, 4 and 6) of the strip to engage the sealing surface 22 of the cover plate 21. As shown in FIG. 1, the vent plate 40 of each door 11 is mounted along the bottom horizontal frame member 16 and is substantially shorter than such frame member. Thus, the outwardly spaced sealing surface 45 of the strip 41 of the vent plate 40 in this instance is significantly shorter than the horizontally extending portions of the sealing surface 22 located at opposite ends of the sealing surface 45.

Formed integrally with and extending downwardly and inwardly from the lower margin of the strip 41 is an inclined web 49 (FIGS. 2 and 6) which terminates at the sealing surface 22 and which defines the bottom of the chamber 43. Several (e.g., four) generally rectangular and horizontally spaced slots 51 are formed through the web 49 and define entrance passages or openings permitting ambient air to enter the chamber 43. The entrance openings 51 are located below the position occupied by the tubular portion 34 of the gasket 33 when the door 11 is closed.

In the embodiment which has been illustrated, a vertical mounting flange 53 is formed integrally with and extends downwardly from the lower margin of the inclined web 49 and lies face-to-face with the outer surface of the cover plate 21. Fasteners such as screws 54 extend through the flange 53 and are secured to the upper flange 18 of the bottom frame member 16 to secure the vent plate 40 removably to the frame member. Herein, there are three screws 54 spaced longitudinally along the flange 53.

The vent plate 40 is completed by a horizontal flange 55 formed integrally with the upper margin of the strip 41 and extending inwardly into overlying relation with the upper end of the bottom frame member 16. The outer portion of the flange 55 defines the top of the chamber 43. Four slots 57 are formed through the corner which is defined at the junction of the strip 41 and the flange 55. The slots 57 are aligned with the entrance openings 51 and define exit passages or openings which permit air in the chamber 43 to be drawn into the interior of the freezer cabinet 15. The exit openings 57 are located above the position occupied by the tubular portion 34 of the gasket 33 when the door 11 is closed and thus are not obstructed by the gasket.

When the door 11 is closed and suction is created in the cabinet 15, ambient air is drawn into the cabinet in a controlled manner and at a predetermined location by flowing into the chamber 43 through the entrance openings 51 and then by flowing out of the chamber and into the interior of the cabinet via the exit openings 57. In this way, ambient air does not enter the cabinet at random points of least resistance, but instead is induced to flow into the cabinet at a controlled location adjacent the bottom frame member 16. Since the flange 18 of that frame member is heated by the cables 20, the ambient air, upon condensing, does not build up as frost on the frame member and, in addition, the heat tends to evaporate the condensation so as to reduce the accumulation of moisture on the frame member.

Some ambient air also tends to flow into the cabinet 15 through the spaces adjacent the ends 46 of the vent plate 40 where the gasket 33 bends around the sealing surface 45 and into engagement with the sealing surface 22. Again, such flow is at a controlled location.

Because the vent plate 40 is a unit which is separate from the door frame 12, it may be easily retrofitted to existing installations such as simply by drilling holes for the screws 54 and attaching the vent plate to the frame with the screws. The vent plate also may be attached in the same manner to the door frame of a new installation and, as will be appreciated by those familiar with the art, a newly manufactured door frame may be made with an integral vent system rather than a vent plate which is separately attached. While in the illustrated embodiment the vent plate is mounted on the cabinet frame and the sealing gasket is mounted on the door, it will be understood by one skilled in the art that alternatively the vent plate could be mountable on the door with the sealing gasket provided on the cabinet frame.

What is claimed is:

1. A refrigerator door assembly for closing an opening in the wall of a refrigerated cabinet, said door assembly comprising a door mounting frame mountable within the cabinet opening and having an outer peripheral portion with a sealing surface, said sealing surface having a primary portion extending along a substantial length of the perimeter of said opening and disposed in a predetermined upright plane, said sealing surface having a shorter portion extending along the remaining length of the perimeter of said opening and disposed in an upright plane which is spaced outwardly from said predetermined plane, an insulated glass door mounted for pivotal movement on said frame between closed and open positions, a flexible sealing gasket on said door and engageable with said sealing surface when said door is in said closed position thereby to seal the interior of the cabinet from ambient air, and passage means permitting limited quantities of ambient air to enter the interior of said cabinet when said door is in said closed position, said passage means being defined in part by a chamber located adjacent said shorter portion of said sealing surface and between the upright plane of said shorter portion and the upright plane of said primary portion, said passage means further including openings permitting ambient air to flow through said chamber and into the interior of said cabinet.

2. A refrigerator door assembly as defined in claim 1 in which said door mounting frame is generally rectangular and includes a generally horizontally extending bottom member, said shorter portion of said sealing surface being on said bottom member, parts of said primary portion of said sealing surface being on said bottom member and being located at opposite ends of said shorter portion of said sealing surface, at least certain ones of said openings being entrance openings located below the position occupied by said gasket when said door is closed and permitting ambient air to flow into said chamber.

3. A refrigerator door assembly as defined in claim 2 in which certain other ones of said openings are exit openings located above the position occupied by said gasket when said door is closed and permitting air in said chamber to flow into the interior of said cabinet.

4. A refrigerator door assembly as defined in claim 2 in which said shorter portion of said sealing surface is defined by the outer face of an elongated strip secured removably to said bottom member and having an inner side spaced outwardly from the outer side of said bottom member, said chamber being defined in part by the inner side of said strip and by the outer side of said bottom member.

5. A refrigerator door assembly for closing an opening in the wall of a refrigerated cabinet, said door assembly comprising a door mounting frame mountable within the cabinet opening, said frame including a generally horizontal bottom member having an outwardly facing surface, means for heating said bottom member, plate means detachably secured to said bottom member and coacting with a portion of the outwardly facing surface thereof to define a chamber, an insulated glass door mounted on said frame for pivotal movement between closed and open positions, a flexible sealing gasket on said door and engageable with said plate means when said door is in said closed position thereby to seal the interior of the cabinet from ambient air, entrance openings formed in said plate means at a location beneath the position occupied by said gasket when said door is closed thereby to permit limited flow of ambient air into said chamber, and exit openings formed in said plate means and permitting ambient air to flow from said chamber and into the interior of said cabinet.

6. A refrigerator door assembly as defined in claim 5 in which said plate means is located between and is spaced from the ends of said bottom member and includes an elongated and generally horizontally extending strip disposed in a generally vertical plane, the outwardly facing surface of said bottom member being disposed in a generally vertical plane spaced inwardly from the plane of said strip, said chamber being defined in part by the inner side of said strip and by said outwardly facing surface of said bottom member.

7. A refrigerator door assembly as defined in claim 6 in which said plate means further includes a web integral with and inclined downwardly and inwardly from said strip, said web defining the bottom of said chamber, said entrance openings being formed through said web.

8. A refrigerator door assembly as defined in claim 7 in which said plate means further includes a mounting flange integral with and extending downwardly from said web and disposed in face-to-face engagement with the outwardly facing surface of said bottom member, and fasteners extending through said flange and into said bottom member to detachably secure said plate means to said bottom member.

9. A refrigerator door assembly as defined in claim 8 in which said plate means further includes a generally horizontal flange integral with and extending inwardly from the upper end of said strip and defining the top of said chamber, said exit openings being formed through said flange.

10. A refrigerator door assembly as defined in claim 6 in which said plate means is substantially shorter than said bottom member and is substantially centered between the ends of said bottom member, said sealing gasket being engageable both with said plate means and with the outwardly facing surface of said outer member when said door is in said closed position.

11. A refrigerator door assembly mountable in an opening in the wall of a refrigerator cabinet comprising a door mounting frame, at least one insulated door mounted on said frame for pivotable movement between open and closed positions relative to said mounting frame, said door including an insulated glass unit having a plurality of glass panes mounted in spaced apart relation to each other with an air insulating space therebetween, means on one of said door and mounting frame for defining a sealing gasket, means on the other of said door and mounting frame for defining a sealing surface against which said gasket is engageable when said door is in a closed position, and said sealing surface defining means includes passage means for permitting ambient air to flow into the interior of the cabinet at a controlled location adjacent said sealing surface.

12. A refrigerator door assembly as defined in claim 11 in which said passage means is defined by a separate attachable plate.

* * * * *